United States Patent [19]

Shin

[11] Patent Number: 5,072,938

[45] Date of Patent: Dec. 17, 1991

[54] GAME BALL HAVING INTERNAL ROTATION IMPARTING MECHANISM

[76] Inventor: Yong Shin, 9322 12th Ave. East, Tacoma, Wash. 98445

[21] Appl. No.: 432,176

[22] Filed: Nov. 6, 1989

[51] Int. Cl.[5] ..... A63B 67/00

[52] U.S. Cl. ..... 273/58 F; 273/26 R; 273/58 K

[58] Field of Search ..... 273/60 R, 58 R, 232, 273/58 F, 58 G, 65 EC, 58 K, 26 R, 213, DIG. 20, 65 EF, 65 ED, 233; 446/431, 458, 462

[56] References Cited

U.S. PATENT DOCUMENTS

| | | | |
|---|---|---|---|
| 2,078,382 | 4/1937 | Hanshaw | 273/58 K |
| 2,939,246 | 6/1960 | Glos II | 446/462 |
| 2,949,696 | 8/1960 | Easterling | 446/462 |
| 2,949,697 | 8/1960 | Lucitis et al. | 446/458 |
| 2,973,800 | 3/1961 | Muccino | 273/233 |
| 3,227,801 | 6/1976 | Ezra | 446/431 |
| 3,453,773 | 7/1969 | Compton et al. | 446/458 |
| 3,700,239 | 10/1972 | Patrick | 273/65 EF |
| 3,874,663 | 4/1975 | Kahle . | |

*Primary Examiner*—Theatrice Brown
*Attorney, Agent, or Firm*—John M. Johnson

[57] ABSTRACT

A game or practice ball is disclosed having a rotation produced by an internal mechanism to cause the ball to curve dramatically when thrown. The ball has a substantially spherical shell. An axle is located diametrically within, and is connected to, the shell. An inertial reference mass in the form of a sphere is located within the shell and is rotatably mounted on the axle. A user released drive means is coupled to the inner sphere and outer shell for rotating the outer shell relative to the inner sphere and portions of the drive so as to impart spin to the shell when the ball is thrown.

22 Claims, 3 Drawing Sheets

GAME BALL HAVING INTERNAL ROTATION IMPARTING MECHANISM

BACKGROUND OF THE INVENTION

This invention pertains to a ball having rotation produced by an internal mechanism. It is well known that a sphere in flight will have a curved path of travel if the sphere is rotating. The amount of spin that a novice can impart to a ball is limited. The present invention employs a mechanism within the ball to impart a rotational force to the thrown ball, independent of the rotational force which the thrower may place on the ball. Thus, a novice can throw a "curve ball" with relative ease.

An example of a ball having an increased rate of spin is U.S. Pat. No. 3,874,663 issued to Kahle. The toy ball of Kahle discloses a hollow ball containing a diametrically extending tube. Two weights are slidably mounted within the tube. Springs urge the weights toward the center of the ball, while user controlled cords attached to the weights keep them apart when the user holds the ball. When the ball is thrown and the cords are released, the springs force the weights toward the center of the ball, thus concentrating the mass distribution of the ball near the center. The spin velocity of the ball increases in order to conserve angular momentum, and the curve of the ball is enhanced. Unlike the present invention, which produces a specific, distinct rotational force regardless of the rotational force, if any, applied to the ball by the thrower, the Kahle device merely enhances the natural rotational force imparted to the ball by the thrower.

SUMMARY OF THE INVENTION

The invention can broadly be summarized as a mechanically rotatable ball having an outer spherical shell, an axle within the outer shell, and a drive mechanism which includes a spring or rubber band or electrically powered motor. The axle is connected to the outer shell such that they rotate as a unit. The drive mechanism causes the axle and outer shell to rotate with respect to certain components of the drive mechanism, such as the drive casing. The outer shell and axle thus rotate in one direction and certain drive mechanism parts, such as the drive casing, rotate in the opposite direction based on the law of action and reaction. Only the rotation of the outer shell, not the rotation of the drive casing, imparts curvature to the path of the thrown ball, this as a result of the air pressure differential created on the surface of the outer shell. The relative rotation of the drive mechanism, including the drive casing, does not directly impart curvature because it is shielded from the external atmosphere by the outer shell.

In the preferred embodiment, the rotation of the outer shell is enhanced either by increasing the inertial mass of the drive mechanism components with respect to which the outer shell rotates, or by adding a rotatable, hollow or solid sphere to the ball within the outer shell.

BRIEF DESCRIPTION OF THE DRAWINGS

To provide a complete disclosure of the invention, reference is made to the appended drawings and following description of preferred and alternative embodiments.

DESCRIPTION OF THE PREFERRED EMBODIMENT

The novel features believed to be characteristic of this invention are set forth in the appended claims. The invention itself, however, may be best understood and its various objects and advantages best appreciated by reference to the detailed description below in connection with the accompanying drawings.

Figure 1:
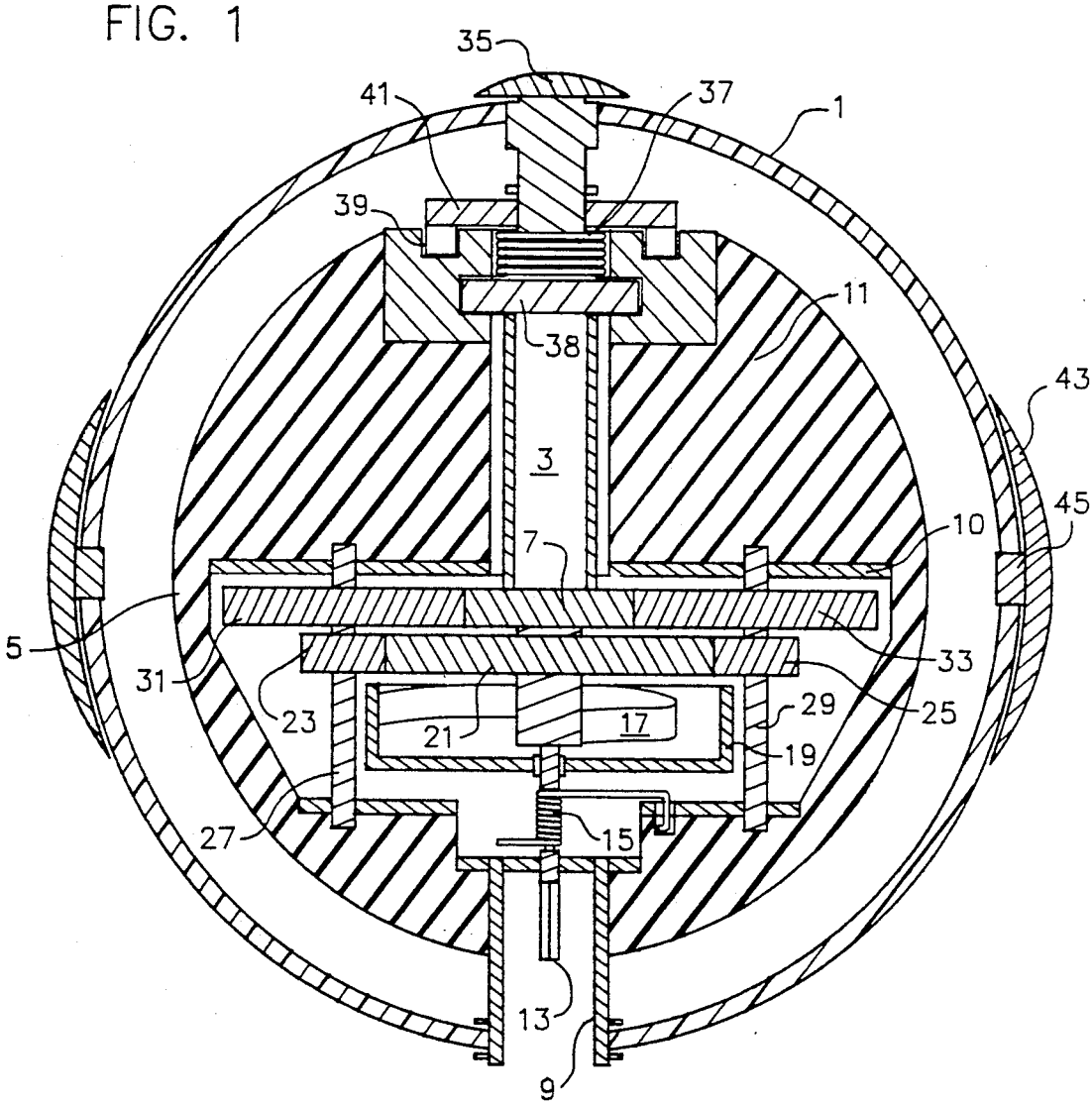
FIG. 1 is a cross-sectional view of the present invention taken at line 1—1 of FIG. 3.
Figure 2:
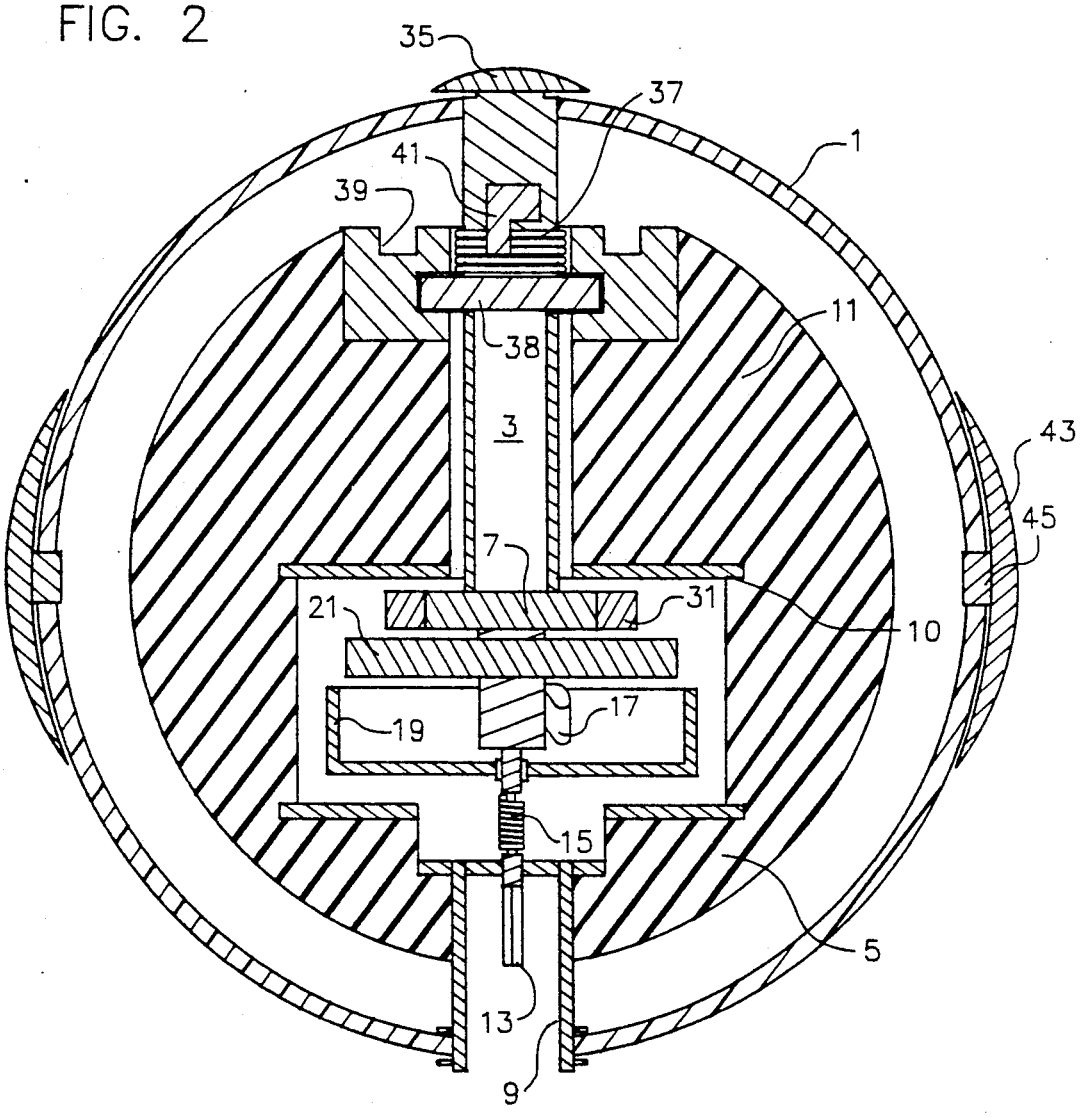
FIG. 2 is another cross-sectional view of the present invention taken at a right angle from FIG. 1.
Figure 3:
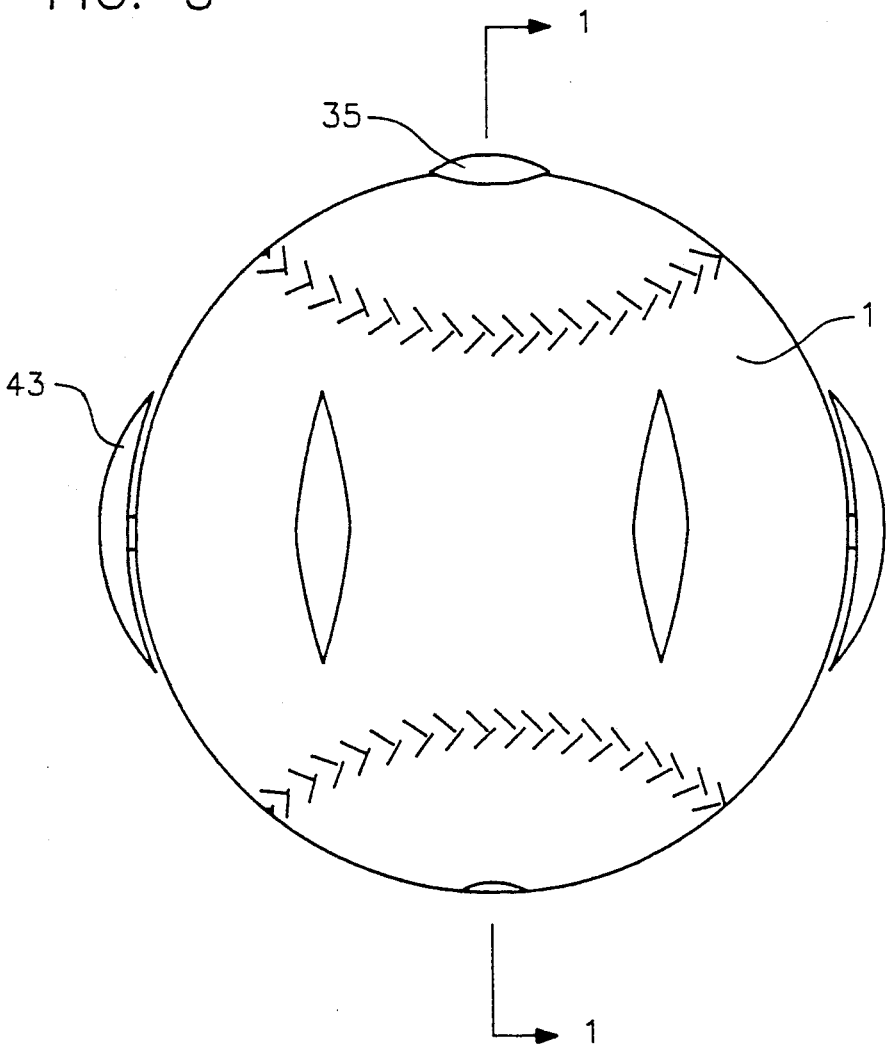
FIG. 3 is an isometric view of the present invention.

Referring to FIGS. 1 and 2, the mechanically rotatable ball of the present invention comprises a spherical outer shell 1 having axle 3 passing through at least a portion of the hollow interior of shell 1. Outer shell 1 is preferably plastic. Axle 3 is connected to shell 1 such that they rotate as a unit. Drive mechanism 5 is attached to axle 3 via gear 7. A channel 9 provides an opening into the interior of shell 1. Drive mechanism 5 preferably includes, and is encased by, drive casing 10. Drive casing 10 and channel 9 rotate with respect to shell 1.

In the preferred embodiment, drive mechanism 5 is also encased by an inner sphere 11 that provides an inertial mass along with drive mechanism 5 relative to which the outer shell 1 rotates in reaction to the force provided by drive mechanism 5. Inner sphere 11 is fixedly attached to channel 9 such that inner sphere 11 rotates as a unit with channel 9 and with drive casing 10 of drive mechanism 5. Alternatively, if drive mechanism 5 has enough mass to cause substantial relative rotation of shell 1, inner sphere 11 may be omitted.

Note that inner sphere 11 may be of other shapes besides spherical, as long as this element is symmetric with respect to its rotational axis around axle 3. In an alternative embodiment, inner sphere 11 may be replaced by a symmetric, relatively high mass object which does not encase drive means 5. For example, a flywheel or other annular mass coaxial with the axis of rotation of shell 1 may be used.

Also note that in the preferred embodiment inner sphere 11 is substantially solid. However, inner sphere 11 may alternatively be a hollow shell. In the most preferred embodiment, the inner portion of the solid inner sphere 11 is comprised of a material such as rubber, or the like, which is able to absorb the forces associated with striking the ball with a low mass baseball bat, such as a plastic bat. The inner sphere 11 thus protects the drive mechanism 5 from damage during actual game play.

Drive mechanism 5 includes, and is powered by, for example, a spring, rubber-band, or electrical motor. In the preferred embodiment, drive mechanism 5 is powered by a spring-powered motor. Note that, in the preferred embodiment, drive mechanism 5 is contained within inner sphere 11. However, drive mechanism 5 may also be external to inner sphere 11.

The elements within shell 1 are preferably weighted, balanced and disposed to prevent unwanted vibrations and eccentric rotation of the components of the ball.

Drive mechanism 5 has a spring-powered motor that includes shaft 13 having a keyed end within channel 9. Shaft 13 is accessible via channel 9 through shell 1 such that shaft 13 can be rotated with a key or the like to wind the spring of drive mechanism 5. Drive mechanism 5 also preferably includes the following components. A lock spring 15 is attached to shaft 13 and allows unidirectional rotation of shaft 13, relative to lock spring 15 and drive casing 10, for winding of main spring 17. Connected to shaft 13 is ring 19. One end of main spring 17 is attached to ring 19. The other end of main spring 17 is fixed to gear 21. Meshed to gear 21 are gears 23 and 25. Gears 23 and 25 are attached to spindles 27 and 29, respectively. Also attached to spindles 27 and 29 are gears 31 and 33, respectively. Both gear 31 and 33 mesh with gear 7, which is attached to axle 3.

Attached in an end of axle 3 is release button 35, which protrudes from the surface of shell 1. Alternatively, release button 35 may be recessed into shell 1. Bias spring 37, seated on support plate 38, urges release button 35 towards the surface of shell 1 and away from axle 3. When depressed, release button 35 grips recesses 39 of inner sphere 11 via arms 41, thus restraining rotation of sphere 11 such that main spring 17 can be wound. The portion of inner sphere 11 containing recesses 39 is preferably metal or plastic to allow gripping of arms 41 without damage to sphere 11. When button 35 is released, inner sphere 11 and outer shell 1 are no longer restrained by the connection through arms 41, allowing the main spring 17 of drive mechanism 5 to unwind. Thus drive mechanism 5 rotates shell 1 and axle 3 in one direction, and rotates drive casing 10 and inner sphere 11 in the opposite direction.

In operation, the user depresses release button 35 with a finger, as just stated, and winds drive mechanism 5 with a key matable to shaft 13. Shaft 13 can be turned clockwise, for example. With the button 35 still depressed, the user then throws the mechanically rotatable ball. As the ball leaves the user's hand, bias spring 37 forces button 35 outward toward the exterior of shell 1, thus releasing arms 41 from the restraining contact with recesses 39. The main spring 17 of drive mechanism 5 is now free to unwind through its point of contact with gear 21. Note that the tension in main spring 17 cannot be relaxed through its contact with ring 19 because ring 19 is fixedly attached to shaft 13 and thus cannot rotate independently of shaft 13. As main spring 17 unwinds, it rotates gear 21 clockwise. Gear 21 turns gears 23 and 25 counter clockwise, which turn spindles 27 and 29 counter clockwise. The rotation of spindles 27 and 29 turns gears 31 and 33 counter clockwise, which then turn gear 7 clockwise. Gear 7 rotates axle 3 clockwise which causes shell 1 to rotate clockwise. The rotation of shell 1 causes a difference in air pressure on the surface of shell 1, which causes a curved path of travel.

As shell 1 rotates clockwise, inner sphere 11 rotates counterclockwise. Also rotating counterclockwise with sphere 11, as a unit, are channel 9, drive casing 10, shaft 13, lock spring 15 and ring 19.

In order to obtain the greatest possible curvature of the mechanically rotatable ball's flight path, the entire mechanically rotatable ball should be as light as possible and the angular velocity of the outer shell (Wo) should be maximized. It is desirable to keep the mechanically rotatable ball as light as possible because, under Newton's Second Law (F=ma), if the same force is applied to two objects, one lighter than the other, the lighter object will move with greater acceleration and velocity. Thus, if the same air pressure differential imparts an identical force on two balls, one lighter than the other, the lighter ball will curve more dramatically.

In order to maximize the angular velocity of the outer shell (Wo), the moment of inertia of shell 1 (Io) should be minimized when compared to the moment of inertia of inner sphere 11 (Ii). Once out of the thrower's hand, the mechanically rotatable ball is an isolated system with no external forces acting on it, disregarding atmospheric friction. The total angular momentum of this system must thus be conserved. Thus, the angular momentum of the shell 1 (Lo) and the inner sphere 11 (Li) must add up to zero, assuming that the mass of sphere 11 includes the mass of drive mechanism 5:

$$Li = Lo \tag{1}$$

Li: the magnitude of the inner sphere's angular momentum generated by the drive means.

Lo: the magnitude of the outer shell's angular momentum generated by the drive means.

From basic mechanics theory we have:

$$\begin{aligned} Li &= Ii * Wi \\ Lo &= Io * Wo \end{aligned} \tag{2}$$

where Io denotes the moment of inertia of the outer shell, Ii denotes the moment of inertia of the inner sphere, Wi represents the angular velocity of the inner sphere, and Wo is the angular velocity of the outer shell.

From (1) and (2) we get:

$$\frac{Wo}{Wi} = \frac{Ii}{Io} \tag{3}$$

Equation (3) shows that the ratio of the angular velocity of the outer shell 1 and of the inner sphere 11 is the inverse of the ratio of the two moments of inertia. Therefore in order to maximize Wo, the angular velocity of outer shell 1, the moment of inertia of the outer shell 1 must be small in value compared to that of the inner sphere 11.

Assuming that the mass of the axle 3 attached to the outer shell is negligible and the materials used for the inner sphere 11 and outer shell 1 are homogeneous, the moments of inertia of the inner sphere 11 and outer shell 1 are, approximately:

$$Ii = (2/5) * Mi * (Ri)^2 \tag{4}$$

$$Io = (2/3) * Mo * (Ro)^2 \tag{5}$$

where Ri denotes the radius of inner sphere 11, Ro denotes the radius of outer shell 1, Mi is the total mass of the inner sphere 11, and Mo is the total mass of the outer shell 1.

Equations (4) and (5) show that the moments of inertia of the outer shell 1 and of the inner sphere 11 are proportional to the mass and the square of the radius of the outer shell 1 and of the inner sphere 11, respectively. In order to maximize the angular velocity of the outer shell 1 (Wo) in relation to the angular velocity of the inner sphere 11 (Wi) in equation (3), one must maximize the moment of inertia of the inner sphere 11 (Ii) in relation to the moment of inertia of the outer shell 1 (Io). Thus, according to equations (4) and (5) in conjunction with equation (3), one can maximize the angular velocity of the outer shell 1 (Wo) by employing an inner sphere 11 with a mass (Mi) greater than the mass (Mo) of the outer shell 1, and also by using an inner sphere 11 having a radius (Ri) as close as possible to the radius (R0) of the outer shell 1.

Assuming that the mechanically rotatable ball is thrown at 25 miles per hour, the ball will travel 60 feet 6 inches (the distance from the pitcher's mound to home plate) in 1.7 seconds. In this time frame, if a gear ratio of 1:6.5 is used for gears 21 and 7, respectively, and if a moment of inertia ratio of 1:2 for the outer shell 1 and inner sphere 11 exists, then four windings of main spring 17 will generate 25 rotations of gear 21 and 10 rotations of outer shell 1.

The mechanically rotatable ball is preferably thrown with axle 3 horizontal, i.e., oriented substantially parallel to the ground, and release button 35 depressed by a finger or thumb from the user's right or left hand. Thus, either a "forward" or "backward" spin is imparted to the ball when thrown, depending on whether the shell 1 is spinning "towards" or "away from" the flight path of the ball. If the shell 1 spins "towards" the direction thrown, the ball will drop. If the outer shell 1 is spinning "away from" the direction thrown, the ball will rise. Note, however, that the mechanically rotatable ball may be thrown with axle 3 in any position relative to the ground, thus allowing many possible curved flight paths.

In a preferred embodiment. release button 35 is located at one of the two "poles" of the ball, and a plurality of protrusions 43 are located substantially equitorially around the surface of outer shell 1. Protrusions 43 perturb the airflow over outer shell 11 as outer shell 1 rotates. Protrusions 43 are preferably aspherical in shape, for example diamond shaped, and may be oriented in a multitude of positions by rotation of protrusions 43 around stems 45 connecting protrusions 43 to outer shell 1. In this manner, the perturbation of the airflow over outer shell 1 can be controlled and directed by the relative orientation of protrusions 43 to cause numerous variations in the flight path. It is readily apparent that combining the many possible orientations of protrusions 43 with the numerous possible orientations of axle 3 of the ball with respect to the ground produces a multitude of possible flight paths.

As alternate embodiments of the present invention, either depressions or apertures (now shown) can be substituted for, or included in addition to, protrusion 43. If apertures are employed, these apertures may be slits which include slidably mounted doors in the spherical surface of shell 1. Each door can be opened or closed to cover all, part, or none of a slit to vary the degree and direction of perturbation of the air pressure on outer shell 1.

While particular embodiments of the present invention have been described in some detail herein above, changes and modifications may be made in the illustrated embodiments without departing from the spirit of the invention.

I claim:

1. A game ball lacking substantial vibratory motion when in flight, said game ball comprising:

a substantially spherical shell;

a drive means fixedly attached to, and within said shell for causing rotation of said shell about an axis intersecting the geometric center of said game ball and with respect to a portion of said drive means that provides an inertial mass which rotates about the axis in an opposite direction to that of said shell, said game ball having a center of mass mainly coinciding with the axis.

2. The game ball having the internal rotation imparting mechanism of claim 1 wherein said portion of said drive means providing an inertial mass is a drive casing enclosing said drive means.

3. The game ball having the internal rotation imparting mechanism of claim 1 wherein said drive means is powered by a spring means.

4. The game ball having the internal rotation imparting mechanism of claim 1 further comprising an axle mounted diametrically within and attached to said shell, said axle coupled to said drive means and imparting rotational force from said drive means to said shell.

5. The game ball having the internal rotation imparting mechanism of claim 1 further comprising an additional inertial mass within said shell, said additional inertial mass attached to said drive means whereby said shell is rotated relative to both said portion of said drive means and said additional inertial mass.

6. The game ball having the internal rotation imparting mechanism of claim 5 wherein said additional inertial mass is an annular mass coaxial with the axis of rotation of said shell.

7. The game ball having the internal rotation imparting mechanism of claim 5 wherein said additional inertial mass is a sphere.

8. The game ball having the internal rotation imparting mechanism of claim 7 wherein said sphere is substantially solid.

9. The game ball having the internal rotation imparting mechanism of claim 7 wherein the difference between the radius of said shell and the radius of said sphere is substantially less than the radius of said sphere.

10. The game ball having the internal rotation imparting mechanism of claim 7 wherein said sphere is hollow.

11. The game ball having the internal rotation imparting mechanism of claim 10 wherein said drive means is within said sphere.

12. The game ball of claim 5 wherein the mass of said shell is substantially less than the combined mass of said additional inertial mass and said portion of said drive means providing an inertial mass.

13. The game ball having the internal rotation imparting mechanism of claim 5 wherein the moment of inertia of said shell is substantially less than the combined moment of inertia of said additional inertial mass and said portion of said drive means providing an inertial mass.

14. The game ball having the internal rotation imparting mechanism of claim 1 further comprising a plurality of protrusions disposed on the exterior surface of said shell for perturbing the air flow over said exterior surface of said shell to cause non-linear movement of said ball when thrown.

15. The game ball having the internal rotation imparting mechanism of claim 14 wherein said protrusions are aspherical in shape.

16. The game ball having the internal rotation imparting mechanism of claim 15 wherein said protrusions include connecting means attaching said protrusions to said shell, said protrusions being rotatable relative to said exterior surface of said shell.

17. The game ball having the internal rotation imparting mechanism of claim 1 further comprising a plurality of depressions disposed on the exterior surface of said shell for perturbing the air flow over said exterior surface of said shell to cause non-linear movement of said ball when thrown.

18. The game ball having the internal rotation imparting mechanism of claim 17 wherein said depressions are aspherical in shape.

19. The game ball having the internal rotation imparting mechanism of claim 1 further comprising a plurality of openings disposed on the exterior surface of said shell for perturbing the air flow over said exterior surface of said shell to cause non-linear movement of said ball when thrown.

20. A game ball lacking substantial vibratory motion when in flight, said game ball comprising:

a substantially spherical shell;

a substantially spherical hollow body within said shell having a mass and moment of inertia substantially greater than the mass and moment of inertia of said shell;

an axle mounted diametrically within and attached to said substantially spherical shell, said axle passing through at least a portion of said substantially spherical hollow body; and a spring-powered drive means within said substantially spherical hollow body, said spring-powered drive means causing rotation of said substantially spherical shell and said axle about said spring-powered drive means includes a casing enclosing said spring-powered drive means whereby said substantially spherical hollow body rotates in a direction opposite to that of said substantially spherical shell and said axle, said game ball having a center of mass mainly coinciding with the axis.

21. The game ball having the internal rotation imparting mechanism of claim 20 further comprising a plurality of aspherical protrusions circumferentially disposed on the exterior surface of said substantially spherical shell for perturbing the air flow over said exterior surface of said shell to cause non-linear movement of said ball when thrown, said protrusions including connecting means attaching said protrusions to said shell, said protrusions being rotatable relative to said exterior surface of said shell to vary the non-linear movement of said ball.

22. A game ball lacking substantial vibrator motion when in flight, said game ball comprising:

a substantially spherical shell;

a substantially spherical hollow body within said shell having a mass and a moment of inertia substantially greater than the mass and moment of inertial of said shell;

an axle mounted diametrically within and attached to said substantially spherical shell, said axle passing through at least a portion of said substantially spherical hollow body;

a spring-powered drive means within said substantially spherical hollow body, said spring-powered drive means causing rotation of said substantially spherical shell and said axle, said spring-powered drive means includes a casing enclosing said spring-powered drive means whereby said substantially spherical hollow body rotates in a direction opposite to that of said substantially spherical shell and said axle, said game ball having a center of mass mainly coinciding with the axis; and a plurality of aspherical protrusions circumferentially disposed on the exterior surface of said substantially spherical shell for perturbing the air flow over said exterior surface of said shell to cause non-linear movement of said ball when thrown, said protrusions including connecting means attaching said protrusions to said shell, said protrusions being rotatable relative to said exterior surface of said shell to vary the non-linear movement of said ball.

* * * * *